United States Patent [19]

Milano, Jr.

[11] Patent Number: 4,805,822

[45] Date of Patent: Feb. 21, 1989

[54] TRACTOR WITH BELT TENSIONING MECHANISM

[75] Inventor: Arthur J. J. Milano, Jr., Burlington, Conn.

[73] Assignee: Data Motion, Inc., Torrington, Conn.

[21] Appl. No.: 135,723

[22] Filed: Dec. 21, 1987

[51] Int. Cl.[4] ..... B65H 20/20; B65H 20/36

[52] U.S. Cl. ..... 226/74; 226/71

[58] Field of Search ..... 226/74, 75, 80, 71; 74/567

[56] References Cited

U.S. PATENT DOCUMENTS

| | | | |
|---|---|---|---|
| 2,820,155 | 1/1958 | Rainey | 74/567 X |
| 3,013,444 | 12/1961 | Burkhard et al. | 74/567 |
| 4,130,230 | 12/1978 | Seitz . | |
| 4,194,660 | 3/1980 | Seitz . | |
| 4,428,519 | 1/1984 | Reichl et al. | 226/75 |
| 4,462,531 | 7/1984 | Seitz . | |
| 4,469,262 | 9/1984 | Seitz . | |
| 4,469,263 | 9/1984 | Seitz . | |
| 4,566,618 | 1/1986 | Seitz et al. . | |
| 4,638,935 | 1/1987 | Wald . | |
| 4,723,697 | 2/1988 | Tano et al. | 226/74 |

FOREIGN PATENT DOCUMENTS

| | | | |
|---|---|---|---|
| 964294 | 3/1975 | Canada | 226/74 |

*Primary Examiner*—Donald Watkins

[57] ABSTRACT

A tractor for driving web material has an endless belt which travels about spaced apart drive and idler sprockets, one of which is an entrance sprocket and the other an exit sprocket. The idler sprocket is journalled in a support member which is movable on the tractor chassis by an adjusting member to vary the spacing between the sprockets and thereby adjust the tension in the belt. The belt carries the paper over a rectilinear path between the sprockets and the chassis has upper surfaces along that path which rise prior to the exit sprocket to lift the paper on the drive pins on the belt and provide a ramp surface clearance to effect clearance of the drive pins in the perforations of the paper so that they rotate downwardly without excessive wear and friction between the web around the perforations and the surface of the pins.

8 Claims, 2 Drawing Sheets

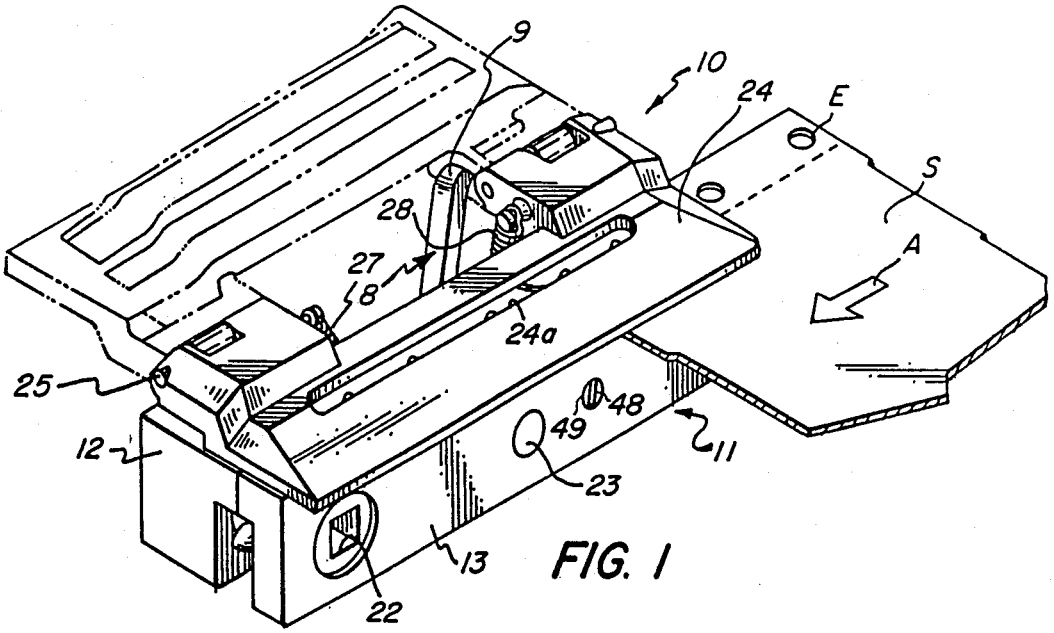
FIG. 1
FIG. 2
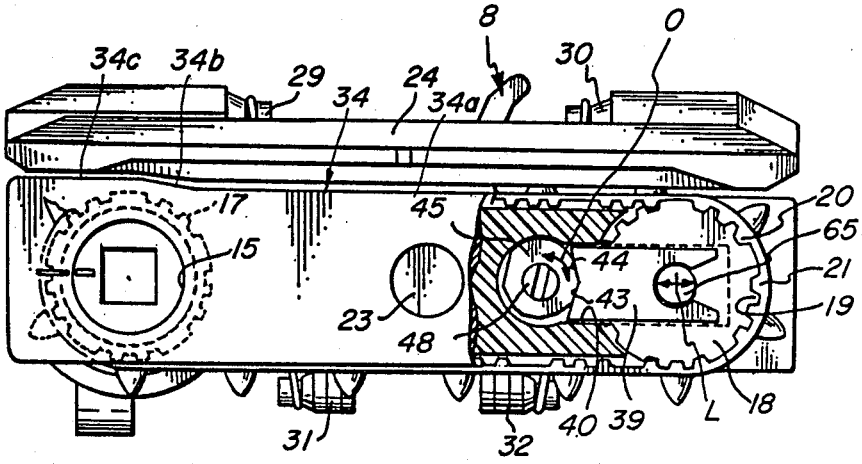
FIG. 3
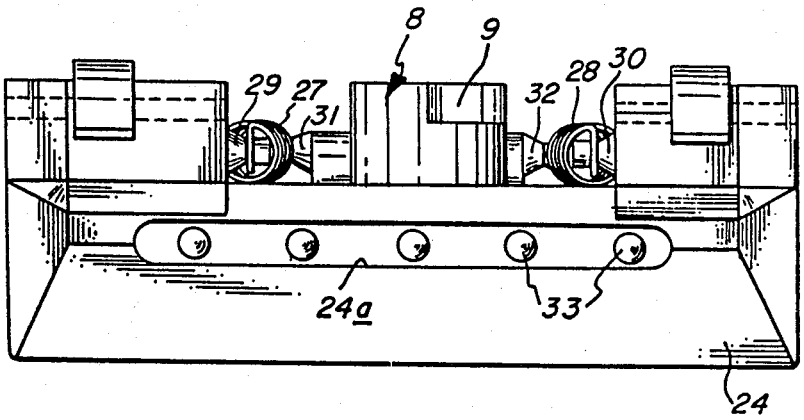

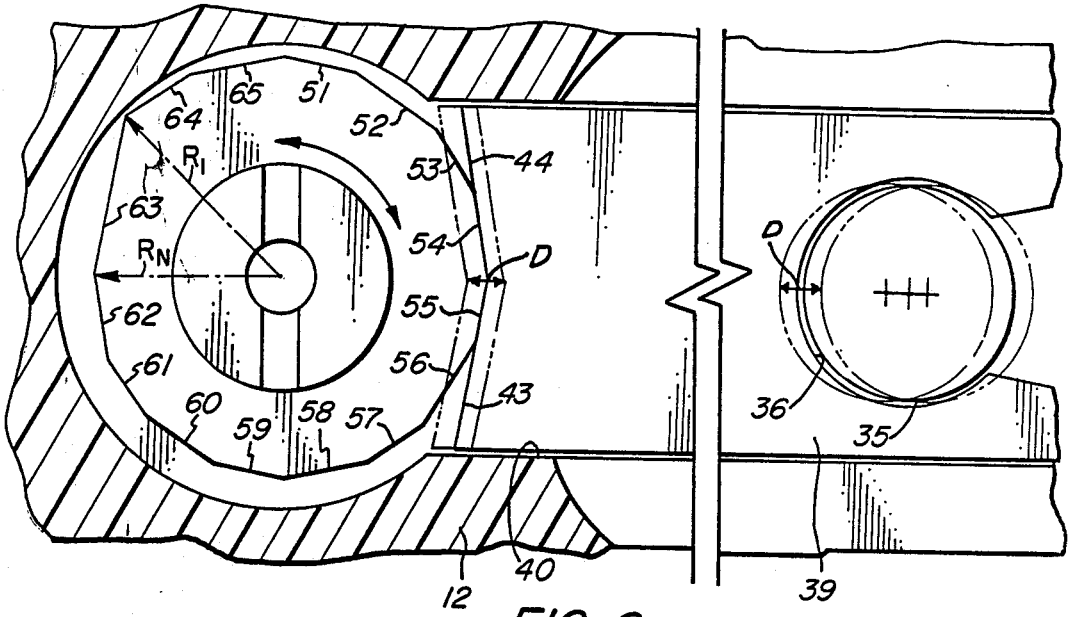
FIG. 6
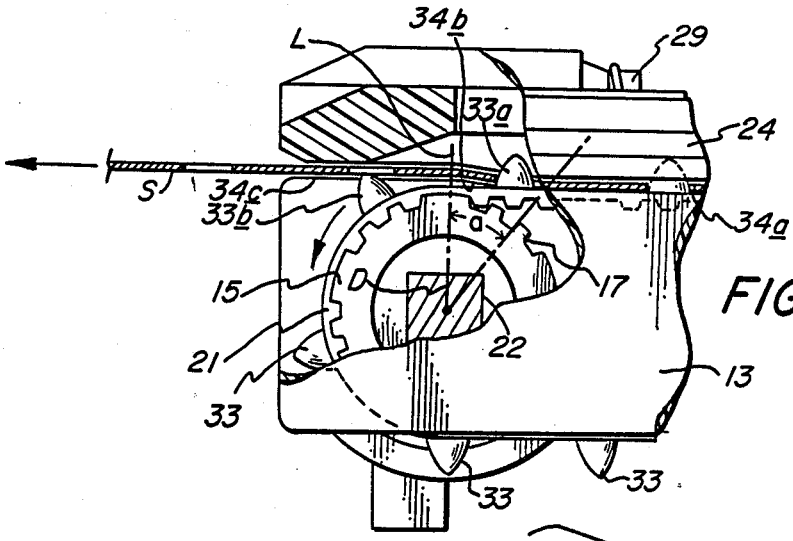
FIG. 4
FIG. 5
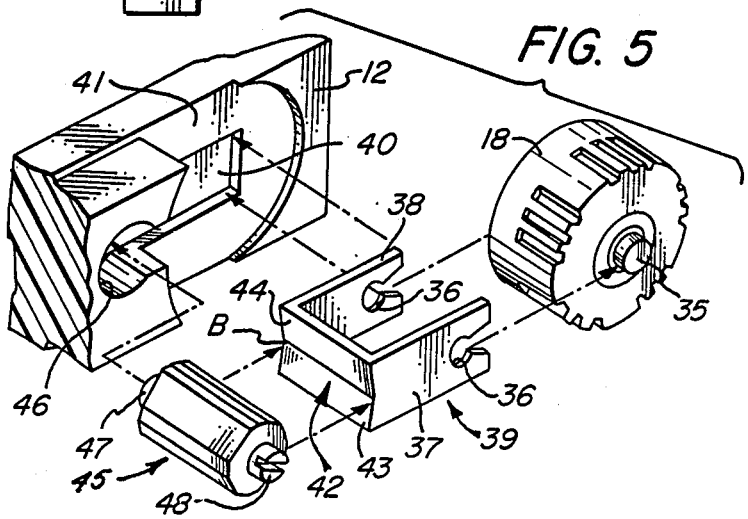

TRACTOR WITH BELT TENSIONING MECHANISM

FIELD OF THE INVENTION

This invention relates to web feed tractors of the type used in printers for automatically advancing webs of paper and the like and, more particularly, to such tractors wherein the tension on the belt may be adjusted.

BACKGROUND OF THE INVENTION

The typical tractor includes an endless drive belt rotatably mounted on the tractor body and driven by a drive sprocket; it may also rotate the belt about a spaced idler sprocket. The drive sprocket is driven by a drive shaft, and rotation causes the drive belt to push or pull the web. There is a rectilinear path for the belt which is tangential to both sprockets and extends therebetween. Most usually, the tractor belt has drive pins on its outer surface which engage in perforations along the sides of the web as they move upwardly about the entrance sprocket, and exit the perforations as the web leaves the tractor as it goes beyond the exit sprocket.

Sheet-feed tractors are typically used in pairs, one for each edge of the web. A support shaft spaced from the drive shaft extends through a spaced opening in the tractor body, and the pair of tractors are clamped to the support shaft at the spacing necessary to allow the pins on the belts to register simultaneously with the perforations in the sheet material.

It is important that the pins cleanly leave the pins of the belt at the exit sprocket to avoid wear on the pins through excessive frictional engagement with the web as the web slides off the pins and to avoid distortion of the perforations in the web.

Particularly in tractors which rapidly and intermittently move the web, or which rapidly move it backwards as well as forwards, both common in printers, it is desirable to provide some slack in the belt between its sprocket supports to absorb some of the forces resulting from the rapid reversal or termination of drive motion. However, it is also desirable to avoid excessive sagging of the belt between the guide surfaces to ensure that the belt holds the web tightly against the cover and firmly seated on the drive pins. Moreover, it is desirable to avoid having the lower surface of the web bear upon the upper surface of the tractor chassis between the sprockets.

It is an object of the present invention to provide an improved tractor with a novel mechanism for adjusting the tension on the drive belt.

It is also an object to provide such a tractor in which the web is moved off the pins on the drive belt in a manner to reduce frictional wear on the pins and distortion of the perforations in the web.

Another object is to provide such a tractor in which the components may be fabricated readily and relatively economically and assembled to provide a long lived tractor.

SUMMARY OF THE INVENTION

It has now been found that the foregoing and related objects and advantages may be readily attained in a drive tractor for web material adapted to be mounted on support and drive shafts in a printer assembly which includes a tractor chassis having a pair of spaced passages extending transversely therethrough and a drive sprocket rotatably mounted in one the passages in the tractor chassis and adapted to receive an associated drive shaft for driving thereby upon rotation of the drive shaft about its longitudinal shaft. An idler sprocket is rotatably mounted on a support member which in turn is mounted on the chassis for movement longitudinally thereof. An endless belt is disposed about the tractor chassis in engagement with the idler and drive sprockets for rotation by the drive sprocket upon rotation of the drive sprocket by the associated drive shaft, and the outer surface of the drive belt being adapted to engage an associated web and advance it through the tractor along a substantial rectilinear path between the sprockets upon rotation of the belt. Means is provided on the chassis for moving the support member longitudinally of the chassis relative to the drive sprocket to vary the spacing between the sprockets and thereby the tension on the belt.

In the preferred embodiment, the support member has the idler sprocket journalled thereon adjacent the end thereof spaced from the drive sprocket and it is slidably supported on the chassis. The moving means effects sliding of the support member on the chassis, and it desirably comprises a cam member rotatably supported on the chassis and acting upon the other end of the support member. Preferably, the cam member has a multiplicity of cam surfaces about its periphery to provide different amounts of motion of the support member on the chassis. The other end of the support member has a V-shaped surface and the cam member has rectilinear surfaces about its periphery converging at apices at different radial spacing from the axis of rotation of the cam member and receivable in the V-shaped surface.

In the usual form, the support member is of yoke-like configuration with the idler sprocket disposed between the arms thereof. The belt has drive pins on its outer surface to engage in the perforations of the associated web material, and the chassis has a ramp surface adjacent the sprocket at the exit end of the rectilinear path of the drive beltbetween the sprocket. The ramp surface is inclined upwardly towards the exit end of the tractor, and the ramp surface commences at a point along the rectilinear path and rises to a height above the belt at a point defined by an imaginary line perpendicular to the rectilinear path and extending radially from the axis of rotation of the sprocket at the exit end. The ramp surface terminates adjacent the imaginary line and the drive sprocket is the exit sprocket.

BRIEF DESCRIPTION OF THE DRAWINGS

FIG. 1 is a perspective view of a tractor embodying the present invention with the cover also shown in phantom line in the open position and with a paper web fragmentarily illustrated;

FIG. 2 is a side elevational view of the tractor of FIG. 1 with the side cover and a portion of the chassis broken away to reveal internal structure;

FIG. 3 is a top plan view of the tractor;

FIG. 4 is a fragmentary elevational view of the tractor at the exit sprocket thereof with portions thereof broken away to reveal internal construction and drawn to an enlarged scale;

FIG. 5 is an exploded fragmentary perspective view of the idler sprocket end of the tractor with the cover, belt and top cover removed, and drawn to the scale of FIG. 1; and FIG. 6 is a fragmentary elevational view drawn to an enlarged scale and in partial section of the idler sprocket end of the tractor chassis showing the yoke, cam and sprocket shaft, and showing several elements in phantom line in two alternate adjusted positions.

DETAILED DESCRIPTION OF THE PREFERRED EMBODIMENT

Turning first to FIGS. 1–3, therein illustrated is a tractor generally designated by the numeral 10 and comprising a body generally designated by the numeral 11 provided by the chassis 12 and cover 13. Rotatably mounted on the body 11 are a drive pulley 15 having drive teeth 17 about its periphery, and an idler pulley 18 also having drive teeth 19 about its periphery. The teeth 17 and 19 of both pulleys 15, 18 engage teeth 20 on the inner surface of the endless drive belt 21 which extends thereabout.

A rectangular passage 22 extends through the drive pulley 15 and receives a drive shaft (not shown) of rectangular cross section. A circular passage 23 extends through the members 12 and 13 and receives a support shaft (not shown). The tractors 10 also includes a top cover or paper guide 24 shown in a closed position in full line in FIG. 1, and in the open position in broken line. The top paper cover or guide 24 is hingedly mounted on the chassis 12 by the hinge pins 25, and is held in the open and closed positions by over center springs 27 and 28 acting between the seats 29 and 30 on the cover 24, and seats 31 and 32 on the lower portion of the chassis 12.

As shown in FIG. 1, the belt 21 is drivingly engaged with a paper web S having perforated edges E along its margins, and it moves paper web S in the direction of the arrow A. On the outer surface of the belt 21 are drive pins 33 of bullet-shaped configuration which enter the perforations E and transport the paper web S through the tractor 10. An elongated aperture **24*a* in the top cover or guide member 24 receives the pins 33 as they travel along the linear path of the belt 21 between the sprockets 15 and 18**.

The tractor 10 has a clamping mechanism generally designated by the numeral 8 to clamp the tractor onto the support shaft (not shown) by rotation of the lever or actuating arm 9. Various clamping mechanisms may be employed such as those shown in Seitz U.S. Pat. No. 4,315,585 and Hubbard U.S. Pat. No. 4,129,239. However, an improved clamping mechanism is described in detail in copending application Ser. No. 07/137,260 filed Dec. 22, 1987 concurrently herewith by Karl G. Seitz entitled "Tractor With Improved Locking Action" and assigned to the same assignee as the present application.

As shown in FIGS. 2 and 4, the top surfaces 34 of the side cover 13 and of the side edge of the chassis 12 between the sprockets 15, 18 extend rectilinearly as seen by the numeral **34*a* over most of its length at a height below the top surface of the belt 21. As it approaches the drive sprocket 15 or exit end of the tractor 10, the top surfaces have a ramp surface portion 34*b*** which is inclined upwardly.

In the embodiment shown, the drive sprocket 15 is an exit sprocket and idler sprocket 18 is an entrance sprocket. However, the tractor may be constructed so as to push the paper rather than pull as shown. If this is the case, then idler sprocket 18 would be the exit sprocket.

As seen in FIG. 4, a portion of the web S exiting the tractor and commences to climb ramp surface **34*b* from the surface 34*a* prior to reaching the centerline of sprocket 15, which is shown as receiving a drive shaft D. As sprocket 15 turns through the angle a web S is riding up ramp surfaces 34*b* and the web S about the perforation engaged by drive pin 33*a* is rising with respect to the pin 33*a* to a portion of lesser diameter on pin 33*a*. As this occurs, the web S is being driven by the pins 33 following pin 33*a*. Meanwhile, the pin 33*b* has just left the preceding perforation in web S as it travels over surface portion 34*c***.

Thus, as the web S travels up the ramp surface **34*b* prior to reaching the acceleration point denoted by broken lines L, the web S commences to lift off of the pin 33*a* and frictional abrasion of the web S on the pin 33 is reduced. At the acceleration point denoted by the line L, the web S has substantially lifted with respect to pin 33*a*, and there is substantial clearance about the pin 33*a* in the perforation. Now, as the pins 33 start to accelerate by changing direction as exemplified by pin 33*b*, it moves downwardly by clearing the perforation without substantial rubbing on the sides of the web defining the perforation. Therefore, there is no tendency for the pins 33 to carry the web S with the belt 21 about the exit sprocket, and there is reduced wear on the pins 33** due to repeated rubbing on the web.

Turning now to FIG. 5, therein illustrated is the structure of a belt tensioning mechanism for effecting tensioning of the belt 21. The idler sprocket 18 has stub shafts 35 which seat in bearing recesses 36 defined in the ends of legs or arms 38 and 38 of the V-shaped yoke member 39. As seen in FIGS. 2 and 4, the yoke member 39 has one leg 38 received in a rectangular recess 40 defined in wall 41 of chassis 12 and it has limited sliding motion therein along the longitudinal axis of the chassis 12. The bight or base portion 42 of the yoke member 39 is formed with two converging surfaces 43 and 44 defining an obtuse angle therebetween and abutting at the apex B.

A cam member generally designated by the numeral 45 is received in a partially circular recess 46 in the chassis 12 and has stub shafts 47 and 48 which are received in a bearing aperture (not shown) in wall 41 of chassis 12 and in the aperture 49 in the side cover 13. The shaft 48 is slotted and a blade inserted into the slot enables rotation of the cam member 45. The periphery of the cam member 45 is formed with a multiplicity of flat surfaces 51–60 which converge at apices and form obtuse angles with radial distances $R_1$ - $R_n$ to the apices. The radii $R_1$ - $R_n$ vary in distance from the smallest to the largest by the distance D shown in FIG. 6. This distance D is the permitted linear adjustment of the position of idler sprocket 18 to suitably tension belt 12 about drive sprocket 15 and idler sprocket 18. As shown, the cam member 45 provides 15 different positions of idler sprocket 18. Adjacent flat surfaces of cam member 45 will abut surfaces 43 and 44 of yoke member 39 and the variation in the radial distance R will effect horizontal motion of the yoke member 39 and thereby the sprocket 18 until the desired tension in the belt 21 is obtained.

Tension in the belt 21 is adjusted after assembly of the tractor by measuring the torque required to turn drive sprocket 15 and then adjusting the tension in belt 21 by rotating the shaft 48 as seen by the bidirectional arrow O to produce the longitudinal movement shown by the arrow L in FIG. 2 until a predetermined torque is required to turn sprocket 15. This arrangement provides quick and positive adjustment of the tension in belt 21.

It will be appreciated that the resilience of the belt 21 will effect return from a more stressed condition.

It may thus be seen that the objects of the invention set forth, as well as those made apparent from the foregoing description, are efficiently attained. While embodiments of the invention have been set forth for purposes of disclosure, modifications to the disclosed embodiments of the invention, as well as other embodiments thereof, may occur to those skilled in the art. Accordingly, the appended claims are intended to cover all embodiments of the invention and modifications to the disclosed embodiments which do not depart from the spirit and scope of the invention.

Having thus described the invention, what is claimed is:

1. In a drive tractor for web material adapted to be mounted on support and drive shafts in a printer assembly, the combination comprising:

(a) a tractor chassis having a pair of spaced passages extending transversely therethrough;

(b) a drive sprocket rotatably mounted in one said passages in said tractor chassis and adapted to receive an associated drive shaft for driving thereby upon rotation of the drive shaft about its longitudial axis;

(c) an idler sprocket;

(d) a support member mounted on said chassis for movement longitudinally thereof and rotatably mounted said idler sprocket on said tractor chassis in spaced relation to said drive sprocket;

(e) an endless belt disposed about said tractor chassis in engagement with said idler and drive sprockets for rotation by said drive sprocket upon driving of said drive sprocket by the associated drive shaft, the outer surface of said drive belt being adapted to engage an associated web and advance it through the tractor along a substantial rectilinear path between said sprockets from the entrance end of the web into said tractor to the exit end upon rotation of said belt; and (f) a cam member rotatably supported on said chassis and having rectilinear surfaces about its periphery converging at apices at different radial spacing from its axis of rotation, said cam member acting upon said support memer to move it longitudinally of said chassis relative to said drive sprocket to vary the spacing between said sprockets and thereby the tension on said belt, said support member having said idler sprocket journalled thereon adjacent the end thereof spaced from said drive sprocket and being slidably supported on said chassis, said cam member effecting sliding of said support member on said chassis, said support member having a recess in its other end in which said cam member is seated, said recess having inwardly sloping surfaces against which said rectilinear surfaces of said cam member bear to provide different amounts of longitudinal motion of said support member upon rotation.

2. The tractor of claim 1 wherein said recess in said other end of said support member has a V-shaped surface.

3. The tractor of claim 1 wherein said support member is of yoke-like configuration with said idler sprocket disposed between the arms thereof.

4. The tractor of claim 1 wherein said belt has drive pins on its outer surface to engage in the perforations of the associated web material, said chassis having a ramp surface adjacent the sprocket at the exit end of the rectinilear path of said drive belt between said sprockets, said ramp surface being inclined upwardly towards the exit end of the tractor, said ramp surface commencing at a point along said rectilinear path and rising to a height above said belt at a point defined by an imaginary line perpendicular to said rectilinear path and extending radially from the axis of rotation of said sprocket at the exit end.

5. The tractor of claim 4 wherein said ramp surface terminates adjacent said imaginary line.

6. The tractor of claim 4 wherein said drive sprocket is the sprocket adjacent the exit end of said tractor.

7. In a drive tractor for web material adapted to be mounted on support and drive shafts in a printer assembly, the combination comprising:

(a) a tractor chassis having a pair of spaced passages extending transversely therethrough;

(b) a drive sprocket rotatably mounted in one said passages in said tractor chassis and adapted to receive an associated drive shaft for driving thereby upon rotation of the drive shaft about its longitudinal axis;

(c) an idler sprocket;

(d) a support member mounted on said chassis for movement longitudinally thereof and rotatably mounting said idler sprocket on said tractor chassis in spaced relation to said drive sprocket, said support member having one end of yoke-like configuration with said idler sprocket disposed between the arts thereof;

(e) an endless belt disposed about said tractor chassis in engagement with said idler and drive sprockets for rotation by said drive sprocket upon driving of said drive sprocket by the associated drive shaft, the outer surface of said drive belt being adapted to engage an associated web and advance it through the tractor along a substantial rectilinear path between said sprockets from the entrance end of the web into said tractor to the exit end upon rotation of said belt; and (f) a cam member for moving said support member longitudinally of said chassis relative to said drive sprocket to vary the spacing between said sprockets and thereby the tension on said belt, said support member having said idler sprocket journalled adjacent its end spaced from said idler drive sprocket and being slidably supported on said chassis, said cam member being rotatably supported on said chassis and acting upon the other end of said support member to effect sliding of said support member on said chassis, said cam member having a multiplicity of cam surfaces about its periphery to provide different amounts of motion of said support member on said chassis, said other end of said support member having a V-shaped recess in which said cam member is disposed, and said cam surface of said cam member being rectilinear surfaces about its periphery converging at apices at different radial distances from its axis of rotation and bearing upon the converging surfaces of said recess.

8. The tractor of claim 7 wherein said belt has drive pins on its outer surface to engage in the perforations of the associated web material, said chassis having a ramp surface adjacent the sprocket at the exit end of the rectinilear path of said drive belt between said sprockets, said ramp surface being inclined upwardly towards the exit end of the tractor, said ramp surface commencing at a point along said rectilinear path and rising to a height above said belt at a point defined by an imaginary line perpendicular to said rectilinear path and extending radially from the axis of rotation of said sprocket at the exit end.

* * * * *